US006490230B1

(12) United States Patent
Sakuyama et al.

(10) Patent No.: US 6,490,230 B1
(45) **Date of Patent: *Dec. 3, 2002**

(54) ELECTRONIC WATCH WITH METER FUNCTION AND DISPLAY MEANS

(75) Inventors: Masao Sakuyama, Tokorozawa (JP); Kenji Shimoda, Hoya (JP); Shinichi Yamada, Tokyo (JP); Kenji Miyasaka, Tokorozawa (JP); Nobuyuki Uehara, Tokyo (JP); Noritoshi Suzuki, Kawaguchi (JP)

(73) Assignee: Citizen Watch Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/039,211

(22) PCT Filed: Apr. 14, 1992

(86) PCT No.: PCT/JP92/00466

§ 371 (c)(1),
(2), (4) Date: Apr. 14, 1993

(87) PCT Pub. No.: WO92/18916

PCT Pub. Date: Oct. 29, 1992

(30) Foreign Application Priority Data

Apr. 16, 1991 (JP) ..... 3-033847
Aug. 2, 1991 (JP) ..... 3-068534

(51) Int. Cl.[7] ..... G04B 47/06; G04B 19/04; G04B 25/00

(52) U.S. Cl. ..... 368/11; 368/80; 368/223

(58) Field of Search ..... 368/11, 10, 223, 368/80

(56) References Cited

U.S. PATENT DOCUMENTS

| | | | | |
|---|---|---|---|---|
| 3,696,610 A | | 10/1972 | Charbonnier | 368/1 |
| 4,466,285 A | | 8/1984 | Allemano | 73/865.1 |
| 4,694,410 A | | 9/1987 | Murata | 364/558 |
| 4,783,772 A | | 11/1988 | Umemoto et al. | 368/11 |
| 4,809,550 A | | 3/1989 | Faulconer | 73/300 |
| 4,835,716 A | | 5/1989 | Tamaki et al. | 364/558 |
| 4,995,015 A | | 2/1991 | Chiang | 368/11 |
| 5,619,478 A | * | 4/1997 | Mutoh | 368/223 |
| 6,385,134 B1 | * | 5/2002 | Lange et al. | 368/11 |

FOREIGN PATENT DOCUMENTS

| | | |
|---|---|---|
| JP | 49-56979 | 8/1947 |
| JP | 51-25583 | 8/1949 |
| JP | 58-85185 | 8/1983 |
| JP | 62-153792 | 12/1987 |

* cited by examiner

*Primary Examiner*—Vit Miska
*Assistant Examiner*—Jeanne-Marjuerite Goodwin
(74) *Attorney, Agent, or Firm*—Thompson Coburn LLP

(57) ABSTRACT

An electronic watch with a meter function, capable of a multifunctional display, wherein the dial of the watch is divided into a data display region and a mode display region and the area for displaying the mode, and the area for displaying functional quantities are increased to make the graduations easier to read, with one hand indicating a data display region for data corresponding to physical quantities, and one hand indicating the mode region.

30 Claims, 8 Drawing Sheets

ELECTRONIC WATCH WITH METER FUNCTION AND DISPLAY MEANS

FIELD OF THE INVENTION

The present invention relates to an electronic watch with a meter function, capable of a multifunctional display.

BACKGROUND AND SUMMARY OF THE INVENTION

In recent years the development of multifunctional models of electronic watches has progressed, centered around digital models. There are, for example, as shown in Japanese Unexamined Utility Model Publication No. 1-126590, watches which are provided with a water depth measurement function and which digitally display various types of data. There has also been a rapid advance in multifunctional development for watches which use hands for display, and hand-display-equipped watches with multiple functions equal to those of digital watch have been commercialized. However, the multiple functions of hand-display-equipped watches have few degrees of freedom for display in comparison with the digital display device as above mentioned because the display means are hands. For this reason, the various restrictions in display present problems. For example, one problem is a means which specifically points out the current functional mode.

FIG. 1 is a display section of a multifunctional watch with hands for display illustrating a first conventional example disclosed in Japanese Unexamined Patent Publication No. 59-56185. The reference numeral 1 designates an hour hand, the reference numeral 2, a minute hand, and the reference numeral 3, a second hand, displaying normal time. The reference numeral 4 is a section in which both a functional quantity and a mode are displayed by means of an accessory hand 4*a*. In this example there are two functions—dual time and a timer. The display of the respective functional quantities is provided in identical left and right display sections with engraved graduations. The mode and the functional quantity are displayed simultaneously by the accessory hand 4*a*.

FIG. 2 is a display portion of a multifunctional watch with hands for display illustrating a second conventional example as published in The Horological International Correspondence, December 1990, Vol. 31, No. 368, page 319. The reference numeral 5 designates an hour hand, the reference numeral 6, a minute hand, and the reference numeral 7, a second hand, displaying normal time. The reference numeral 8 designates a mode display section in which a mode is displayed by means of an accessory hand 8*a*, and is made up of a normal display mode, a dual time mode, a timer mode, and an alarm mode. The timer mode shown in FIG. 2 indicates the current time. The reference numeral 9 designates a function display hand for displaying the functional quantity for each function selected by the mode display section 8.

The display area for the functional quantities in the first conventional example is small because a plurality of functional quantities is displayed within one display section. This causes a problem inasmuch as the graduations are difficult to read. Because the display area becomes smaller as the number of functions increases the graduations become more and more difficult to read.

In the second conventional example, the mode is indicated by a dedicated accessory hand to eliminate the problems found in the first conventional example. The functional quantities are indicated by one dedicated display hand provided in the center of the watch. With this method, the mode is easily distinguished because the mode is indicated by the dedicated accessory hand, and because the same function indicating hand is also used to indicate the function status, the area of the display section is large and the graduations are easy to read. However, a dedicated mode-indicating accessory hand must be provided, therefore a dedicated gear train is required and the module space is restricted. In addition, the hand spacing is increased to use the accessory hand, and this results in design restrictions.

Some types of electronic watches equipped with a metering function are capable of providing a water depth indicating function. However, in engraving the graduations the meter in the water depth measurement mode, a method is used in which the time graduations of the watch are also used to indicate water depth, and another method is used in which graduations are provided on the circumference separate from the time graduations. However,in the conventional method by which the above-mentioned time graduations do double duty, a total of 60 m of uniform graduations is used for 60 divisions of graduations corresponding to the time portion, at one graduation for 1 m.

The method by which one revolution contains 60 divisions of uniform graduations conforming to the graduations of the watch portion is extremely easy to read because this is the method used in a normal, familiar type of watch. However, in this method, when the resolution of one graduation is small, such as for example one meter, the display range only extends to 60 meters. In addition, in the case where one graduation is made equivalent to 5 m to expand the display range, it is possible to increase the display range to 300 m, but this has the drawback that the reading precision is poor. Also, in the method where the time graduations are independent and not dual purpose, there is a production problem in providing new graduations on the face plate. In addition, deciding what graduations are to be used for what purpose also presents a problem because there is a plurality of graduations, and these graduations are difficult to read.

Further, the measured values for water depth and the like in a hand display device, are normally displayed each time a measurement is made, and the maximum value is not displayed simultaneously when the measurements are taken. When it is desired to know the maximum value, during measurement the maximum value is first recorded, and when the measurement has been completed this maximum value is usually retrieved.

DISCLOSURE OF THE INVENTION

A first object of the present invention is, with due consideration to the drawbacks of such conventional watches, to provide an electronic watch with a meter function wherein the display areas for mode and for functional quantities are large, the graduations are easy to read, and a small watch with a thin shape is possible.

A second object of the present invention is to provide an electronic watch with a meter function with an expanded display range while maintaining the resolution of the time graduation double duty method.

A third object of the present invention is to provide a device with a hand display which can provide a diver with a sense of security by simultaneously displaying the diving depth and maximum diving depth values.

The first object of the present invention is achieved by the provision of an electronic watch with a meter function comprising a data signal generating means for generating physical quantity data signals, a mode signal generating means for generating mode signals, a watch face and an annular display region surrounding the watch face, the watch face having a plurality of hands. The annular display region includes an arcuate data display region for displaying data other than time and an arcuate mode display region, wherein the arcuate data display region and the arcuate mode display region do not overlap. Also, one of the hands indicates a value in the arcuate data display region in response to a data signal from the data signal generating means, and one of the hands indicates a mode in the arcuate mode display region in response to a mode signal from the mode signal generating means.

The second object of the present invention is achieved by the provision of a watch face as a dial for an electronic watch with hands wherein the time graduations and a meter are in a one-to-one correspondence in a fixed angle range from a standard position for the graduations on the dial, and, in the dial range in which the fixed angle is exceeded, the meter graduations for the time graduations correspond to double that amount.

The third object of the present invention is achieved by the provision of a device with a hand display comprising a signal detection means; a signal processing means for converting a signal output from the signal detection means to a digitalized detection signal; a first motor drive circuit for creating a motor drive signal from an output signal from the signal processing means; a first motor which is driven by the first motor drive circuit; and a detected signal indicating hand driven by the first motor; and further comprising a maximum value memory means; a second motor drive circuit for creating a motor drive signal according to a value recorded in the maximum value memory means; a second motor which is driven by the second motor drive circuit; a maximum value indicator hand which is driven by the second motor; a comparison means for comparing the detection signal and the value stored in the maximum value memory means; and a maximum value rewrite means for rewriting the detection signal into the maximum value memory means in accordance with a compared signal from the comparison means; whereby the maximum value indicator indicator hand indicates the maximum value from among the detected signals.

PREFERRED EMBODIMENTS FOR IMPLEMENTING THE INVENTION

Figure 1:
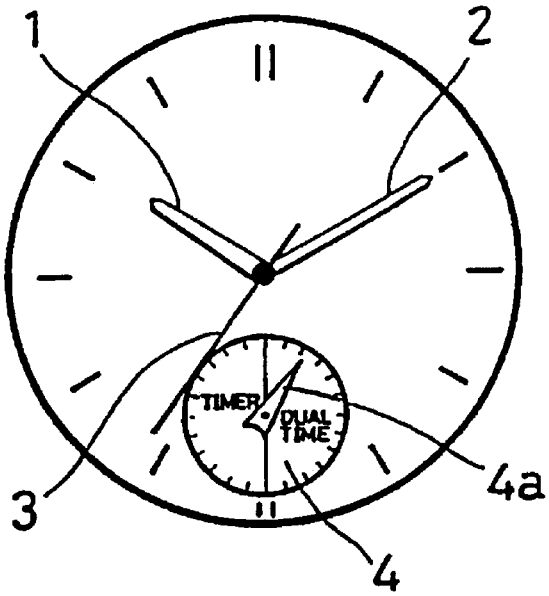
FIG. 1 illustrates an example of a display section of a conventional multifunctional watch with hands for display.
Figure 2:
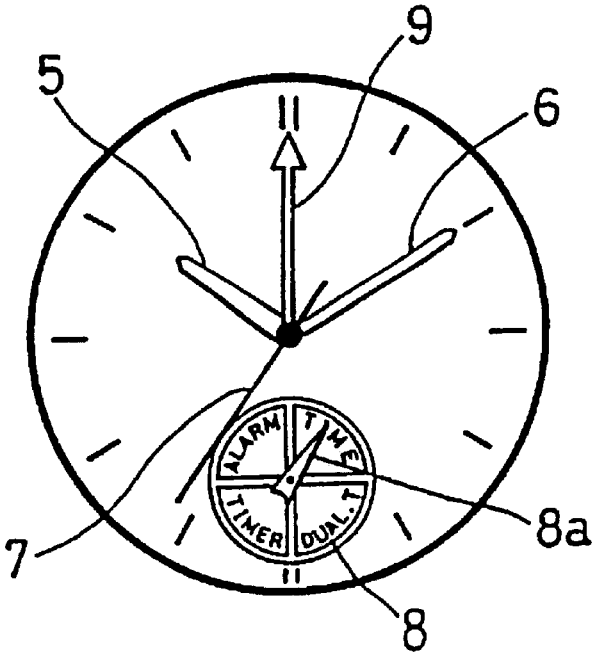
FIG. 2 illustrates another example of a display section of a conventional multifunctional watch with hands for display.
Figure 3:
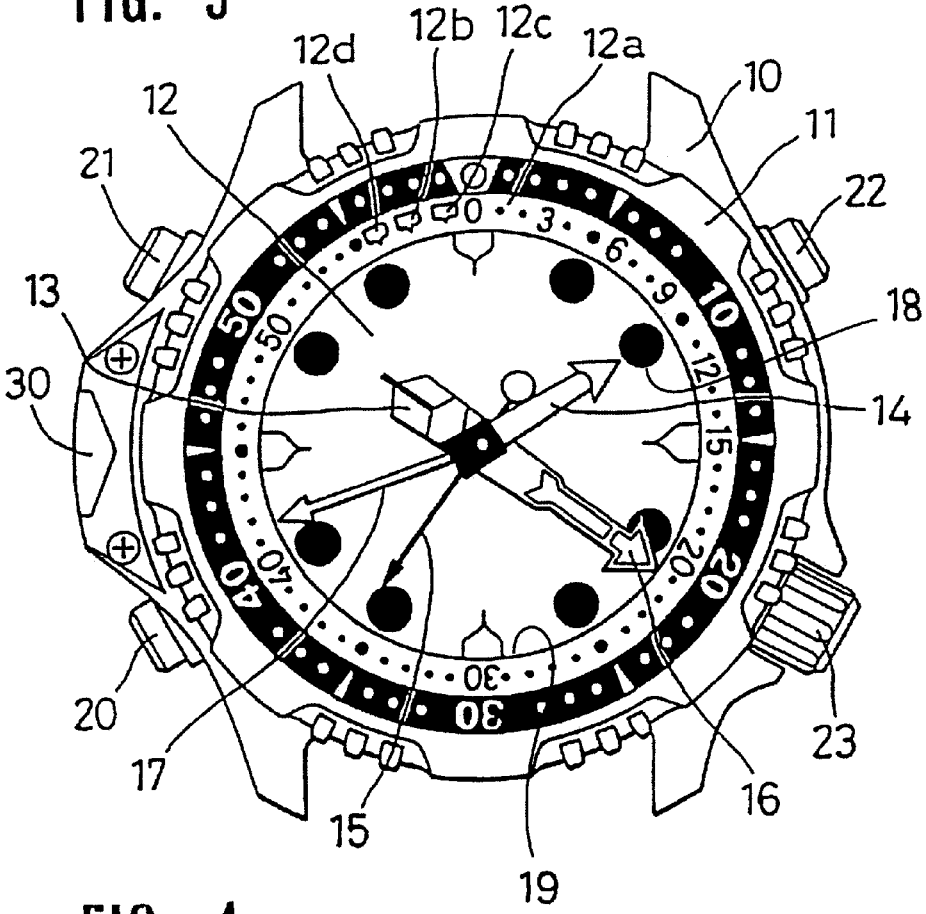
FIG. 3 is a view of the external appearance of a watch with hands for display provided with a water depth measurement function, as a first embodiment of the present invention.
Figure 4:
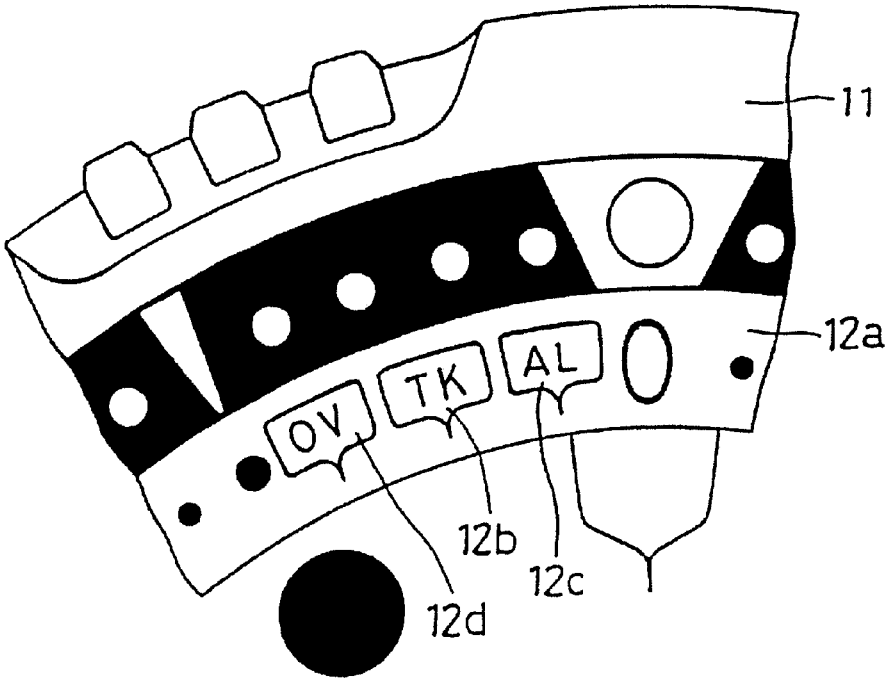
FIG. 4 is an enlarged view of the mode display section of the watch shown in FIG. 3.

FIG. 3 is a view of the external appearance of a watch with hands for display provided with a water depth measurement function, as a first embodiment of the present invention. The reference numeral 10 designates a watch case, and the reference numeral 11 designates a register ring with minute display graduations engraved on the ring. The reference numeral 12 designates a watch face with minute display graduations engraved on an annular section 12*a* of the watch face 12. A luminous mark 18 is attached to every fifth position on the inside of the display graduations, so that the time and depth displays are easily read by the diver while diving. The display graduations are used in combination with the water depth graduations. In the display units for water depth, one graduation division is one meter, and the water depth is displayed in a display region from the 12 o'clock position (0 m graduation position) up to the 55th graduation position (55 m graduation position). Furthermore, a TK mark 12*b* showing the time mode, an AL mark 12*c* showing a depth alarm setting mode, and an "OV' mark 12*d* showing an exceeded depth measurement are engraved on the annular section 12*a*, between the 12 o'clock position and the 55 minute graduation position, as shown by the enlargement in FIG. 4. The 12 o'clock position also serves as a mark showing a water depth measurement mode.

The display 12*a* surrounding the watch face 12 is an arcuate data display region for a water depth meter from the 12 o'clock position (0 m display position) to the 55 minute graduation position (55 m graduation position), and is an arcuate mode display region from the 55 minute graduation position to the 12 o'clock position. Specifically, viewed from the 12 o'clock position in the clockwise direction, the forward region is the data display region and the rear region is the mode display region. Together, the arcuate data display region and the arcuate mode display region form an annular display region surrounding the watch face 12.

In the center section of the watch face 12, time display hands, made up of an hour hand 13, a minute hand 14, and a second hand 15; a depth hand 16; and a maximum depth hand 17 in combined use as a mode display hand are provided. The hour hand 13, the minute hand 14, and the second hand 15, are formed to be driven by a different motor from the depth hand 16 and the maximum depth hand 17. The reference numerals 20, 21, and 22 designate push buttons, and the reference numeral 23 designates a crown. These are all formed as external operating members for correction and/or change of displayed data. The reference numeral 30 designates a water pressure sensor for detecting depth.

The pushbutton 20 is provided for switching a mode into the time mode, the depth alarm setting mode, and the depth measurement mode. Operating the pushbutton 20 for a short time (less than two seconds) switches the maximum depth hand 17 to the TK position which indicates the time mode, and to the AL position which indicates the depth alarm setting mode. Continuously depressing the pushbutton 20 for a fixed time switches the maximum depth hand 17 to the 0 m graduation position which indicates the depth measurement mode. When the maximum depth hand 17 indicates the position of the "TK" mark 12*b*, the depth hand 16 stands by on the 0 m graduation position and indicates that this is the time mode.

In the time mode state selected by the operation of the pushbutton 20, a maximum depth memo is called up when the pushbutton 22 is operated, and a sound monitor for a depth alarm and a rate of ascent alarm is heard when the pushbutton 21 is operated.

When the depth alarm setting mode is selected by operating the pushbutton 20 and the maximum depth hand 17 is moved to the "AL" mark 12*c* position, the depth hand 16 moves to the set depth if the depth alarm has already been set. If the depth alarm has not yet been set the depth hand 16 stands by at the 0 m graduation position.

It is possible to set the value for the depth setting alarm both forward and in reverse in 1 m units by operating the push buttons 21, 22 in the alarm setting mode. Setting this alarm causes the depth alarm to be sounded if the depth value exceeds the value to which the depth alarm setting value is set when the diver dives with the watch in the depth measurement mode. In the depth measuring mode, the rate of ascent alarm is used to communicate the occurrence of a sudden ascent (for example, in excess of 4 m per sec) which can cause an adverse effect on the body.

Next, when the water depth measurement mode is selected by continuously depressing the pushbutton 20 for a fixed time (two seconds or greater in this embodiment), the maximum depth hand 17 moves to the 0 m graduation position, and, at the same time, water depth can be measured with the depth hand 16 standing by at the 0 m graduation position. In this state, when the diver dives so that depth measurement is commenced, the depth hand 16 and the maximum depth hand 17 move to indicate the depth value. The depth hand 16 indicates the current depth during diving and the maximum depth hand 17 ordinarily indicates the maximum depth position during the dive (same action as a maximum point keeping hand). Then, the depth alarm is sounded if the measured depth value exceeds the depth alarm set value.

Furthermore, when a dive occurs to a depth which is greater than the maximum 55 m of the indication range of the depth measurement, the depth hand 16 and the maximum depth hand 17 are quickly activated, both hands move immediately to the position of the "OV" mark 12*d* which indicates an excessive depth measurement, and the depth alarm is sounded. In addition, when the diver has ascended to the depth measurement display region, the depth hand 16 indicates the current depth and the maximum depth hand 17 continues to indicate the position of the "OV" mark 12*d*.

The crown 23 mechanically performs revision of a calendar when pulled out to a first stage and revision of the time when pulled out to a second stage, but is normally pushed in to the 0 stage.

Figure 5:
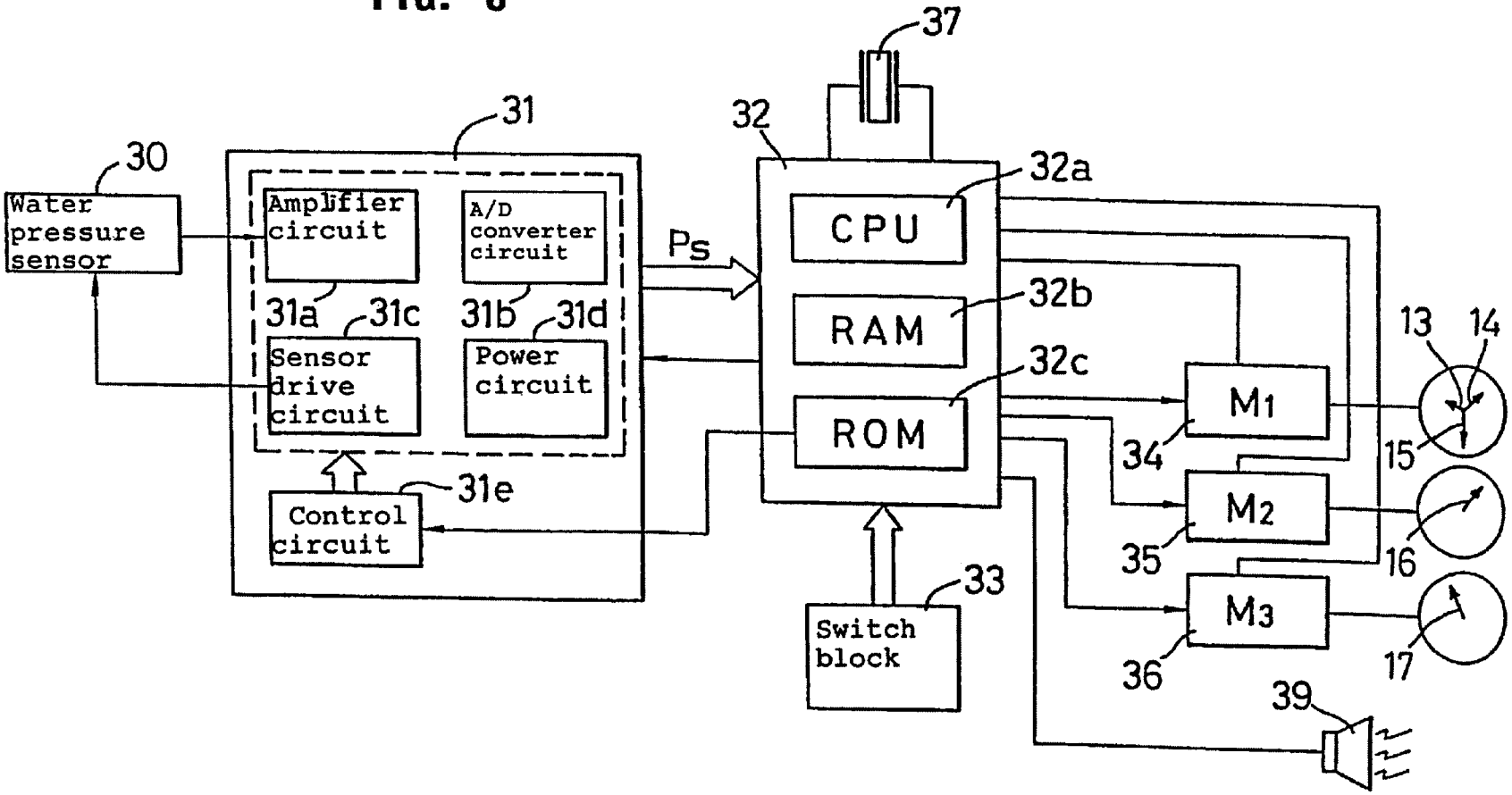
FIG. 5 is a block diagram of the first embodiment of the present invention shown in FIG. 3.

FIG. 5 is a block diagram showing the basic structure of a watch 1 with hands for display provided with a water depth measurement function of which the external appearance is shown in FIG. 3.

The reference numeral 30 designates a water pressure sensor made up of a diaphragm-type semiconductor, which outputs an electric sensor signal corresponding to changes in water pressure. The reference numeral 31 designates a water pressure measurement circuit comprising a commonly-known amplifier circuit 31*a*, an A/D conversion circuit 31*b*, a sensor drive circuit 31*c*, a power circuit 31*d*, and a control circuit 31*e*. The reference numeral 32 designates a microcomputer section basically comprising a CPU 32*a*, a RAM 32*b*, and a ROM 32*c*. A program for controlling the CPU 32*a* is stored in the ROM 32*c*. The CPU 32*a* inputs water depth data Ps from the water pressure measurement circuit 31 and data from a later-described switch block 33, and outputs operating signals to a plurality of motors 34, 35, 36 based on this data after the necessary processing, according to the program. The reference numeral 37 designates a quartz oscillator for generating a clock signal. The switch block 33 is a switching group operated through the push buttons 20, 21, 22 and the crown 23 shown in FIG. 3.

The motor 34 drives a time display device to which the hour hand 13, the minute hand 14, and the second hand 15 are linked. The motor 35 drives the depth hand 16, and the motor 36 drives the maximum depth hand 17. The reference numeral 39 designates a buzzer for sounding an alarm.

Next, the operation of the above-mentioned watch with hands for display provided with a water depth measurement function will be explained with reference to FIG. 6 and FIG. 7.

First, the mode which has been selected by the diver is determined by reference to the depressed condition of the pushbutton 20 (mode selector MS) (F-1). After determination, the maximum depth hand 17 indicates the "TK" mark 12*b* showing the time mode (F-2), and the depth hand 16 indicates the 0 m graduation position (F-3) when in the time mode (MS=0). Then, time display processing (F-4) is performed, and the time is displayed by the hour hand 13, the minute hand 14, and the second hand 15. During this period a judgement is made (F-5) as to whether or not the pushbutton 20 has once again been depressed by the diver (Is the mode select switch MS-SW being operated from the pushbutton 20 in the ON state?). If the pushbutton 20 has not been depressed again, the time processing is repeated by returning to step (F-4), and the time is displayed continuously. Also, during the operation, a judgement is made as to whether the operating time is 2 seconds or greater, or not (F-6). Then, if 2 seconds or greater, the depth measurement mode (MS=2) is set (F-7), and the program returns to step (F-1); if less than 2 seconds, the depth alarm setting mode (MS=1) is set (F-8) and the program returns to step (F-1). Specifically, if the operation of the pushbutton 20 is less than 2 seconds, the program proceeds to the depth alarm setting mode, and if the pushbutton 20 is depressed for 2 seconds or greater continuously, the program proceeds to the depth measurement mode.

Figure 6:
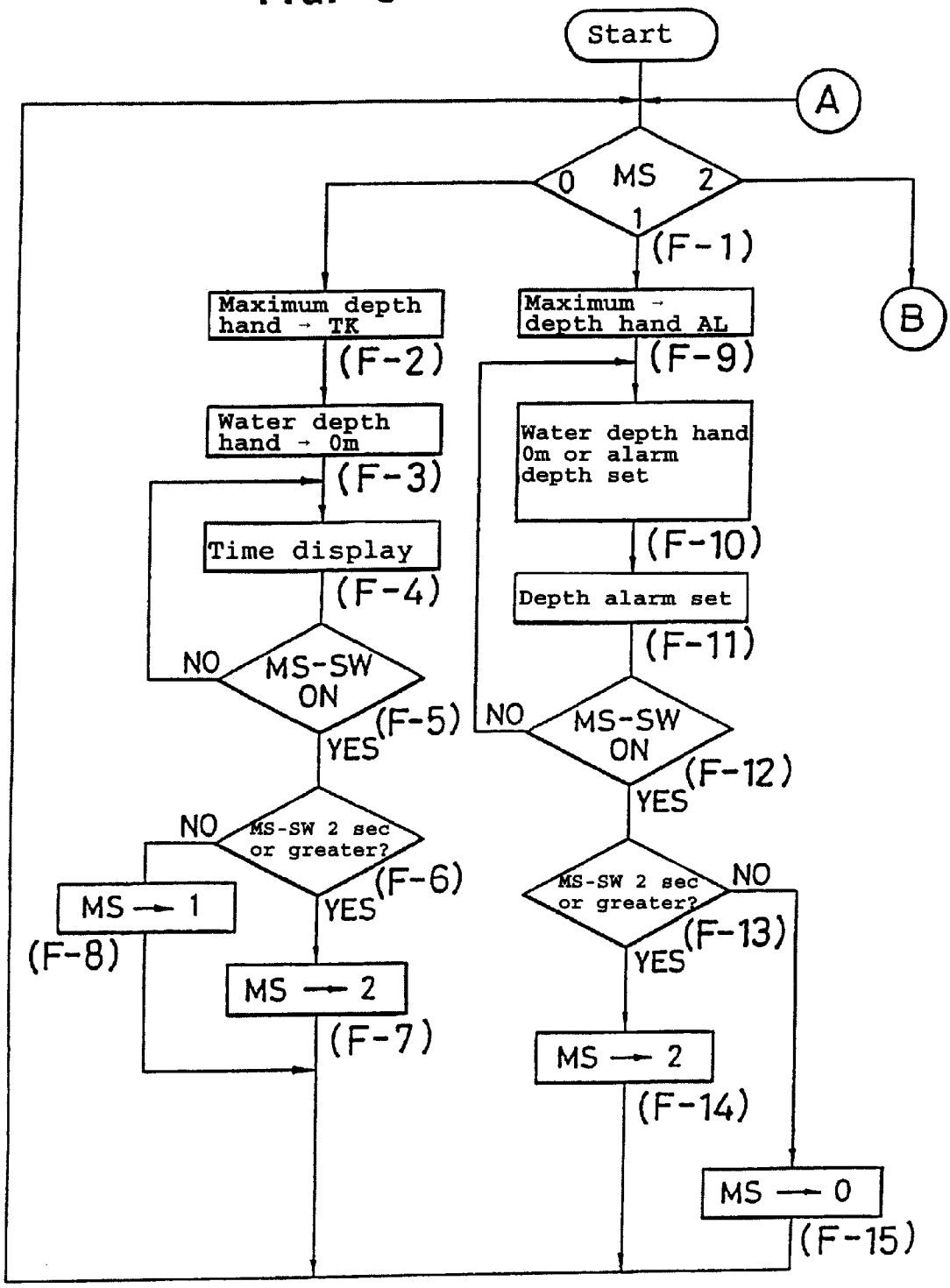
FIG. 6 is one part of a flowchart for the operation of the modes of the first embodiment of the present invention shown in FIG. 3.

Next, when the depth alarm setting mode (MS=1) is set in (F-8), shown in FIG. 6, by the diver operating the pushbutton 20, the program proceeds to (MS=1) in step (F-1), and the maximum depth hand 17 indicates the "AL" mark 12*c* (F-9). At this time the depth hand 16 moves to the 0 m graduation or to the alarm depth graduation previously set (F-10). Here, the pushbuttons 21, 22 are operated and the alarm depth is newly set in one meter units (F-11).

Following this, whether or not the pushbutton 20 is being depressed is distinguished/judged (F-12), and if not being depressed the program returns to step (F-10) and the depth alarm setting operation continues. In addition, if being depressed, whether or not this action continues for 2 seconds or greater is distinguished/judged (F-13). Then, when the pushbutton 20 is depressed for 2 seconds or greater, the depth measurement mode (MS=2) is set (F-14), and the program returns to step (F-1); if less than 2 seconds, the time mode (MS=0) is set (F-15) and the program returns to step (F-1).

Figure 7:
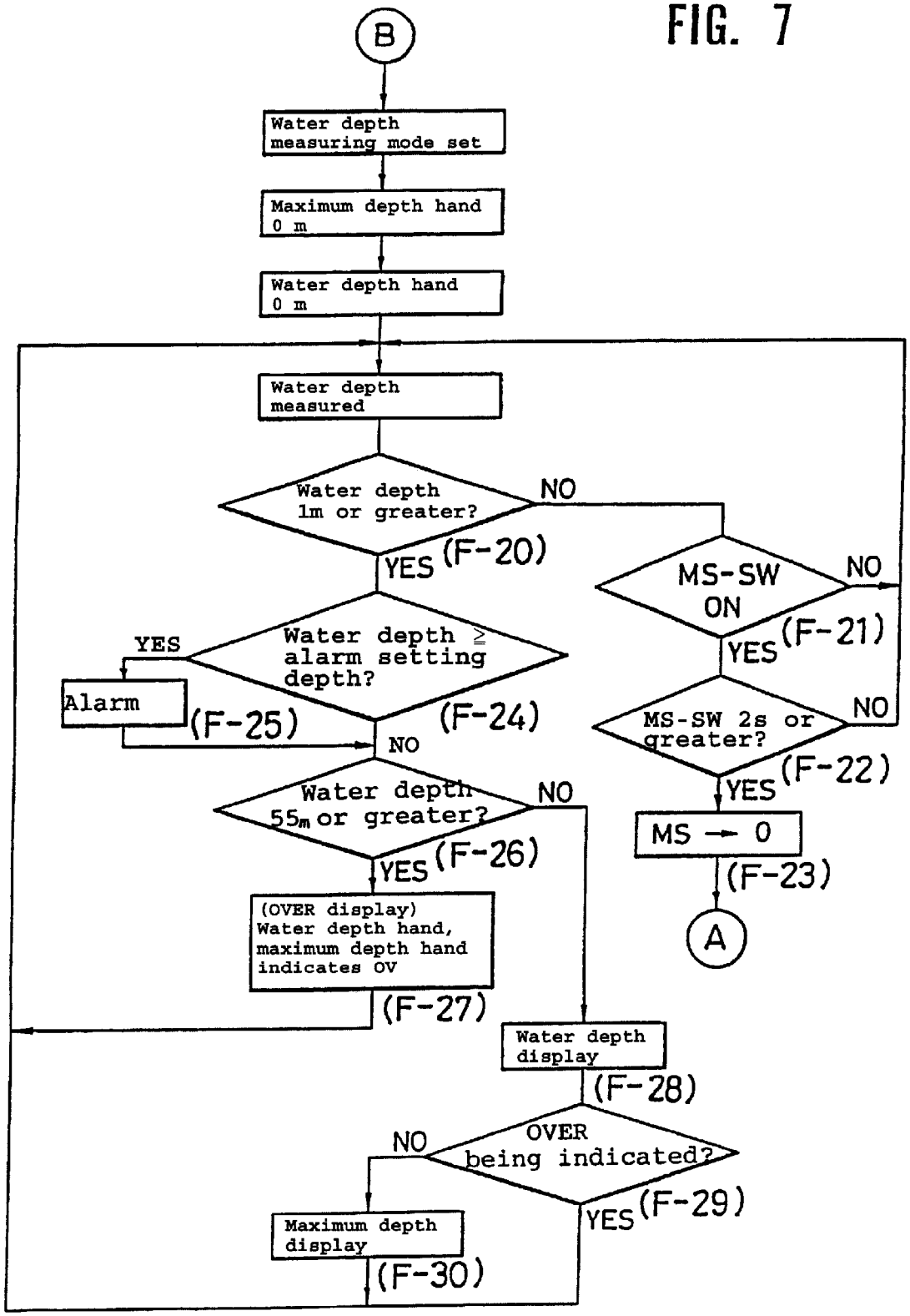
FIG. 7 is a continuation of the flowchart shown in FIG. 6.

Next, when the depth setting mode (MS=2) is selected at step (F-7) or step (F-14) shown in FIG. 6, by the diver operating the pushbutton 20, the program proceeds to (MS=2) in step (F-1), and as shown in FIG. 7, the power voltage is applied to the water pressure sensor 30 and the water pressure measurement circuit 31, and the depth measurement mode is set (F-16), the maximum depth hand 17 moves to the 0 m graduation position (F-17), and the depth hand 16 also moves to the 0 m graduation position (F-18). The fact that both the depth hands 16, 17 point to the 0 m graduation position in this manner informs the diver that the depth measurement mode is set. When the diver starts his dive, the sensor signal from the water pressure sensor 30 is received by the water depth measurement circuit 31, and after being amplified by the amplifier circuit 31*a*, is subjected to an A/D conversion in the A/D conversion circuit 31*b*, and fed to the microcomputer section 32. In the microcomputer section 32, a water depth value is computed by means of a prescribed operational expression (F-19) in accordance with the program stored the ROM 32*c*. Then, a judgement is made as to whether or not the computed water depth value is 1 meter or greater (F-20). If less than 1 m, a judgement is once again made as to whether the pushbutton 20 is ON or OFF (F-21). If the pushbutton 20 is not ON, the program returns to step (F-19) and the water depth measurement continues, but if the pushbutton 20 is ON, a judgment is made as to whether or not the operating time was 2 sec or greater (F-22). If less than 2 sec, the program returns to step (F-19) and the water depth measurement continues. If the operating time was 2 sec or greater, if diver appears to be completing the dive, the time mode (MS=0) is set (F-23) and the program returns to step (F-1) (see FIG. 6).

In the step (F-20), when a decision is made that the water depth is 1 m or greater, a determination is made as to whether or not the water depth has reached the value for the depth set in the depth alarm setting mode (F-24). If this set water depth value has not yet been reached a judgment is made immediately, or, if the set water depth value has been reached and the buzzer 39 is activated, a judgment is made after the depth alarm has sounded (F-25), as to whether or not the water depth value has exceeded the 55 m measurement range (F-26).

Then, if the result of the decision is that the measurement range of 55 m has been reached or exceeded, the depth hand 16 and the maximum depth hand 17 quickly move to the position of the "OV" mark 12*d* which shows the measurement range has been exceeded, thus indicating an overrun (F-27), after which the program returns to step (F-19) and the depth measurement continues. Then, while the diver continues the dive at 55 m or greater, the operations of steps (F-20), (F-24), (F-26), and (F-27) are carried out from step (F-19).

Next, at step (F-26), in the case where the result of the decision is that the measurement range is less than 55 m, that value is indicated as the depth (F-28) by the depth hand 16, and a decision is made (F-29) as to whether or not 'over' has been indicated at step (F-27). Then, in the case where the result of the decision is that 'over' has not yet been indicated, a new maximum depth is indicated (F-30), after which the program returns to step (F-19) and the depth measurement continues. However, in the case where the result of the decision is that 'over' has already been indicated, the program returns to step (F-19) without a new maximum depth being indicated and the depth measurement continues. Specifically, in the case where the diver has once dived beyond the measurement range of 55 m, even if the diver then returns to within the 55 m measurement range, the depth hand 16 returns to the actual depth value display, but the maximum depth hand 17 does not indicate a new maximum depth and remains fixed at the "OV" mark 12*d* because the maximum depth has exceeded 55 m. It is then recorded that 55 m has been exceeded.

Figure 8:
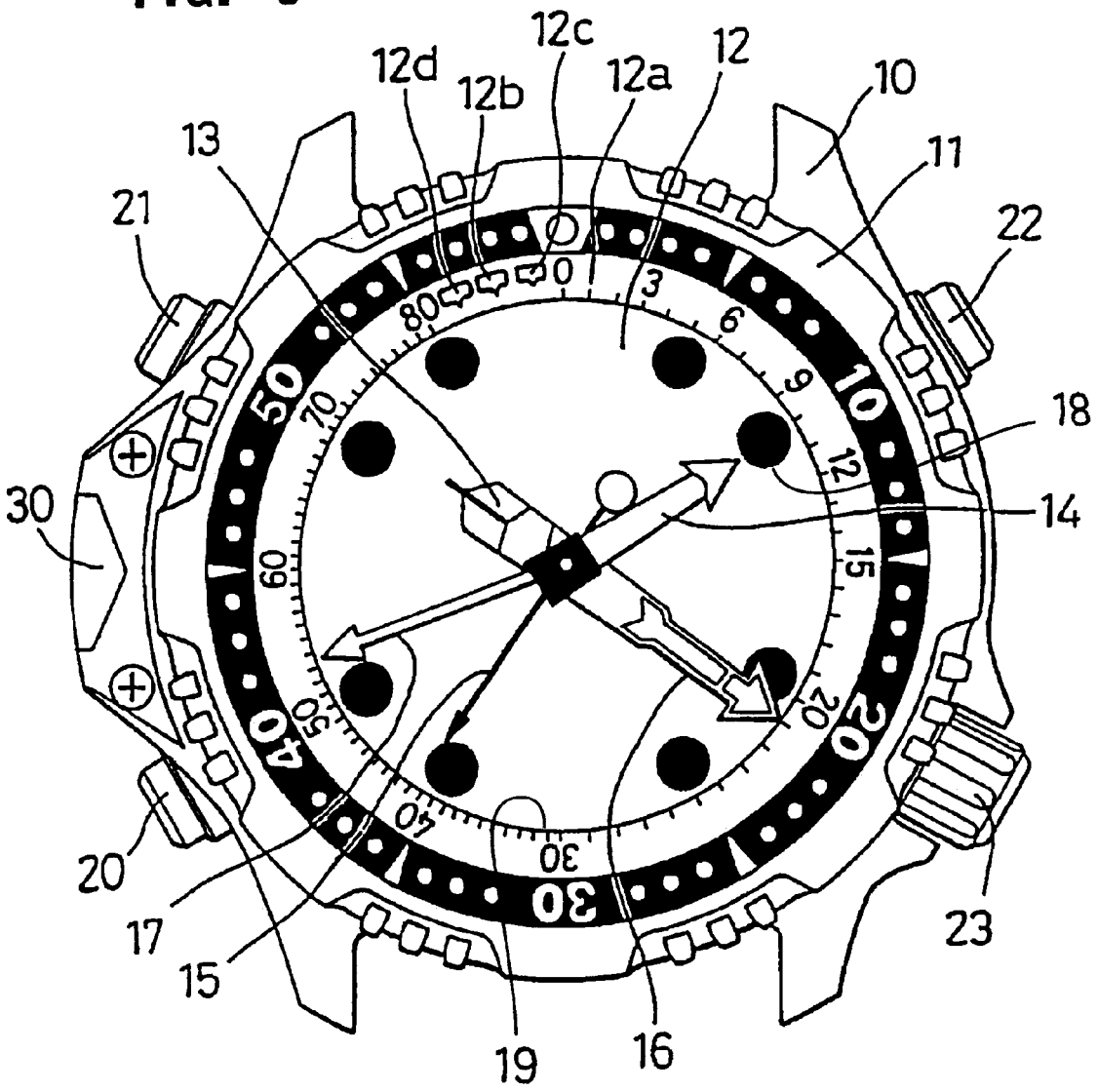
FIG. 8 is a view of the external appearance of a watch with hands for display provided with a water depth measurement function, as a second embodiment of the present invention.

FIG. 8 is a plan view of a watch with hands for display provided with a water depth measurement function, as a second embodiment of the present invention.

The differences in external appearance between this embodiment and the first embodiment shown in FIG. 3 are in the method of indicating the depth graduations of the watch face 12. Specifically, one minute units are engraved on the circumference of the watch 12 up to the 30 min position, and double graduations are used from the 30 min position up to the 55 min position. Specifically, in the embodiment shown in FIG. 8 the display method is such that the units of the depth indicator display are 1 m for each one minute graduation from 0 m to 30 m, and 2 m for each one minute graduation from 30 m to 80 m. Furthermore, small graduations are provided between one minute graduations from 30 m to 80 m. In addition, a plurality of values is embossed at the minute display graduation positions corresponding to the 3 m, 6 m, 9 m positions and the like, so that the depth indicator is easily read.

Figure 9:
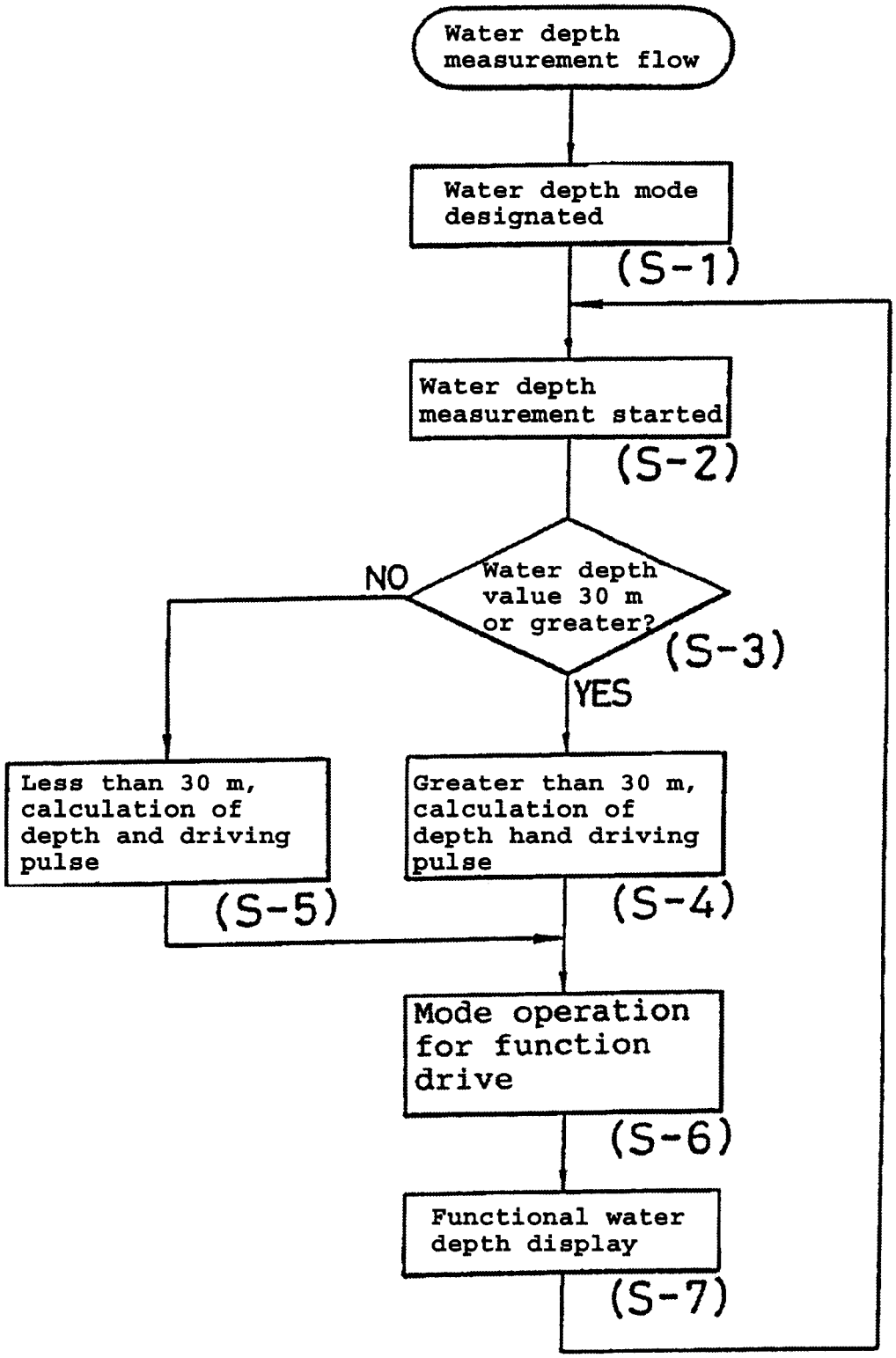
FIG. 9 is a flowchart of the water depth measurement mode of the second embodiment of the present invention shown in FIG. 8.

FIG. 9 is a flowchart showing the operation in the depth measurement mode of the second embodiment.

First, the pushbutton 20, which is the function mode switching button, is operated, and the depth measurement mode is designated (S-1). When the depth measurement mode is designated, the microcomputer section 32 turns the water pressure measurement circuit 31 ON and depth measurement is started (S-2). The depth measurement is performed by the microcomputer section 32 at fixed intervals, the water depth data Ps, which is the sensor signal from the water pressure sensor 30 subjected to an A/D conversion by the A/D convertor circuit 31*b*, is input, the depth value is computed, a water depth judgement is carried out as to whether the water depth value is greater or less than 30 m (S-3), and when greater, the depth hand driving pulse code and a computation is made of the number of pulses for driving the hand to the position where a depth value of 30 m or greater is shown (S-4). Also, at step (S-3), when the judgement is made that the depth is less than 30 m, a computation is made of the depth hand driving pulse code and the number of pulses for driving the hand to the position where a depth value of 30 m or less is shown (S-5), the program advances to the state wherein the depth hand driving motor is operated (S-6), and the depth hand operating pulse code and the number of pulses computed at step (S-4) or step (F-5) are output to the motor 35. As a result, the motor 35 is rotated forward or in reverse according to the depth hand operating pulse code and the number of pulses. When the depth is indicated (S-7) one measurement operation has been completed. The water depth measurement is repeated according to the above method.

Figure 10:
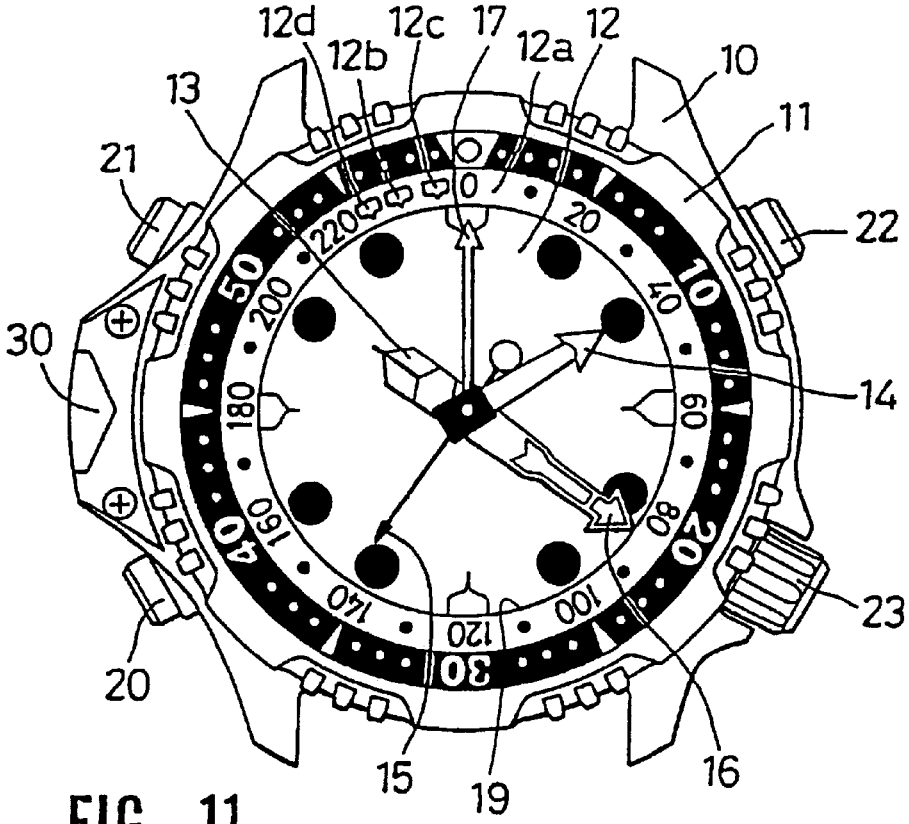
FIG. 10 is a view of the external appearance of a watch with hands for display provided with a water depth measurement function, as a third embodiment of the present invention.

FIG. 10 is a view of the external appearance of a watch with hands for display provided with a water depth measurement function, as a third embodiment of the present invention.

In this embodiment the water depth is indicated in foot units. With the exception of the point that the depth graduations on the watch face 12 are shown in foot units, the external appearance of the watch of the third embodiment is the same as the external appearance of the watch shown in FIG. 3, therefore like reference numerals are used to designate identical or corresponding parts.

In this embodiment, graduations of 20-foot unit numerical values are affixed at each five minute position on the peripheral section 12*a* of the watch face 12 up to 220 feet, and marks corresponding to 10-foot units are affixed as black spots between the graduation numerical values. Also, in the indication of the later-described water depth hand 16, the hand is operated in one-foot units by a motor. The region from the 12 o'clock position (0-foot graduation position) to the 55-minute graduation position (220-foot graduation position) on the watch face 12 becomes a display region for depth indication.

In this embodiment, the processing circuit for a sensor signal and the processing for carrying out a foot display are the same as in the first embodiment shown in FIG. 6, therefore further explanation is omitted.

Figure 11:
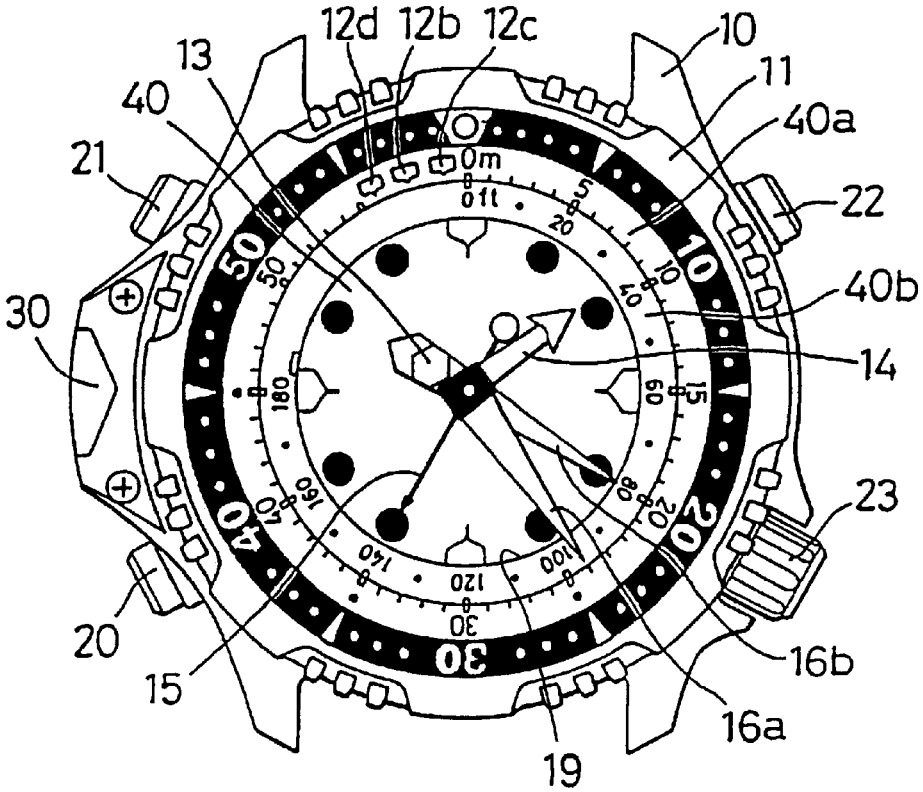
FIG. 11 is a view of the external appearance of a modification of the third embodiment of the present invention shown in FIG. 10.

FIG. 11 illustrates a modification of the third embodiment of the present invention shown in FIG. 10. The water depth is indicated in both meter units and foot units. Therefore, the depth graduations on the watch face are given in both meter units and foot units.

In this embodiment, a meter-unit display section 40*a*, which is graduated in meters, and a foot-unit display section 40*b*, which is graduated in feet, are both provided on the watch face 40. Twenty-foot unit numerical value graduations are affixed at every five-minute position on the foot-unit display section 40*b*, up to 180 feet (equivalent to about 55 meters).

As illustrated in this embodiment, about 50 to 60 m is required as a normal depth to which a diver descends. When it is taken into account that the two types of graduations, meters and feet, are provided, affixed to time graduations of 60 minutes or the like for which this depth is engraved on the watch face, indication of up to 55 m is possible because the meter graduations provide 5 m figures (1 graduation 1 m) at every 5-minute unit. In addition, it is possible to recognize depths for which every 5 m interval is well marked, using luminous marks of 5 min units which are characteristic of a divers watch.

Of course, it is also acceptable to use marks for 5-minute units which are luminous marks in foot-graduations, but when the same depth as in meters is allotted to the 5-min unit marks, the figures provided at the mark become figures such as 18.0, which fall between integral multiples of 10, because 5 meters is 18.0 feet, and these figures are difficult to read for a diver using foot-graduations. Accordingly, in this embodiment, foot figures allotted to marks of 5-min units are selected as closely approximating 5 meters as possible and are well marked off, at 20 feet (4.0 meters).

As a result, the values for depths in meters and feet corresponding to marks of 5 minute units are different, but even in the case where both graduations are used, the figures at the luminous marks are easy-to-read.

Further, in the present embodiment it is possible to read two types of units simultaneously by the provision of both a meter-indicating depth hand 16*a* and a foot-indicating depth hand 16*b* as depth hands for indicating the water depth. The two depth hands 16*a*, 16*b* indicate different positions as shown in FIG. 11, and normally indicate the same water depth value. As outlined above, the time graduations of the watch do double duty. When it is desired to present the necessary depth values to the diver as two types of graduations—meters and feet—which are easy to read, 5 m and 20 feet are allotted to the marks for 5-minute units, and the display range becomes about 55 meters, and it is desirable to make the indicating range 110 meters by allotting 10 m and 40 feet. The figures for the meter graduations for 5-minute units of time may be integer multiples of 5, and those for the foot graduations may be integer multiples of 20. The basic makeup and operation of the depth measurement is the same as for the embodiment shown in FIG. 9. The meter-indicating depth hand 16*a* and the foot-indicating depth hand 16*b* are respectively activated by different motors.

The configuration of the present embodiment is such that the meter-indicating depth hand 16*a* and the foot-indicating depth hand 16*b* are activated by motors, but this is not a limitation of this embodiment. There is a fixed functional relationship between meters and feet which both indicate distances. Therefore one drive motor can be used by linking the meter-indicating depth hand 16*a* and the foot-indicating depth hand 16*b* through a gear train at a fixed reduction ratio, and depths in meter units and foot units can be indicated simultaneously. In this embodiment, the processing circuit and the processing for a sensor signal for indicating feet and meters are also handled in the same manner as in the embodiment shown in FIG. 6 and FIG. 7, so further explanation is omitted.

As explained in the foregoing, data indication and mode indication are made extremely simple in the present invention by dividing the face of an electronic watch with hands for display into a data indicating region and a mode indicating region and using the normal hands for indication. A dedicated hand for mode indication is therefore unnecessary. Also, viewed from the 12 o'clock position on the watch face in the clockwise direction, the major portion of the front half is used for data display, and one part of the rear half is used for mode display, therefore a data display region of adequate size can be obtained and an easily-viewed mode display is possible, conforming to the required number of modes. Also, in the present invention it is possible to enlarge the entire data display region by making the data display region a non-linear display. The resolution of the display of the required parts can also be increased.

In addition, by means of the present invention, the graduations on the watch face are extremely easy to read through combined usage of the time graduations and the function graduations. In particular, even in the case where there is a plurality of units to be read (for example, meter units and foot units), combined usage of these graduations and the time graduations provides an effect whereby the graduations are not complicated with respect to the number of functions which it is desired to display.

What is claimed is:

1. An electronic watch with a meter function comprising:

a data signal generating means for generating physical quantity data signals, a mode signal generating means for generating mode signals, and a watch face, and an annular display region surrounding the watch face, said watch face having a plurality of hands, said annular display region including an arcuate data display region for displaying data other than time and an arcuate mode display region, wherein the arcuate data display region and the arcuate mode display region do not overlap, with one of said hands indicating a value in the arcuate data display region in response to a data signal from the data signal generating means, and one of said hands indicating a mode in the arcuate mode display region in response to a mode signal from the mode signal generating means.

2. The electronic watch with a meter function as claimed in claim 1 wherein the data display region is displayed on a forward portion of the watch face, viewed in the clockwise direction from the 12 o'clock position thereof, and the mode display region is displayed on a rear portion of the watch face.

3. The electronic watch with a meter function as claimed in claim 1 wherein the annular display region has graduations from 0 to 59 minutes and the data display region is displayed from the 0-minute to the 55 minute-graduations, and the mode display region is displayed between the 56-minute and the 0-minute graduations.

4. The electronic watch with a meter function as claimed in claim 1 wherein the data display region has a non-linear scale.

5. The electronic watch with a meter function as claimed in claim 4 further comprising:

a second annular display region surrounding the watch face for displaying the time, wherein a plurality of time graduations are provided in said second annular display region and a plurality of meter graduations are provided in the data display region;

the time graduations and the meter graduations being provided with a one-to-one correspondence within a constant angle range from a standard position on the watch face; and the meter graduations correspond to a multiple of the time graduations in a range on the watch face where said constant angle range is exceeded.

6. The electronic watch with a meter function as claimed in claim 5 wherein the constant angle range is 180°.

7. The electronic watch with a meter function as claimed in claim 1 wherein the mode displayed in the mode display region is related to data for physical quantities displayed in the data display region.

8. The electronic watch with a meter function as claimed in claim 7 wherein the hand which indicates the data display region and the hand which indicates the mode display region are the same hand.

9. The electronic watch with a meter function as claimed in claim 8 wherein the mode displayed in the mode display region includes an overflow display mode in which the data display hand indicates that full scale has been exceeded for the data display region.

10. The electronic watch with a meter function as claimed in claim 1 wherein the data signal generating means comprises a depth data signal generating means for generating a depth data signal and the data display region comprises a water depth meter having a plurality of water depth graduations.

11. The electronic watch with a meter function as claimed in claim 10 wherein the water depth graduations in the data display region are meter graduations.

12. The electronic watch with a meter function as claimed in claim 11 wherein the water depth graduations are non-linear graduations.

13. The electronic watch with a meter function as claimed in claim 12 further comprising:

a second annular display region surrounding the watch face for displaying the time, wherein a plurality of time graduations are provided in said second display region;

the time graduations and the meter graduations being provided with a one-to-one correspondence within a constant angle range from a standard position on the watch face; and wherein the meter graduations correspond to a multiple of the time graduations in a range on the watch face where said constant angle range is exceeded.

14. The electronic watch with a meter function as claimed in claim 11 further comprising:

a second annular display region surrounding the watch face for displaying the time, said second annular display region having a plurality of time graduations, and wherein each one minute time graduation corresponds to one meter in the depth graduations.

15. The electronic watch with a meter function as claimed in claim 13 wherein each one minute time graduation corresponds to one meter in the range from a 0-minute to a 30-minute time graduation, and each one minute time graduation corresponds to two meters in the range beyond a 31 minute time graduation in the water depth graduations.

16. The electronic watch with a meter function as claimed in claim 10 wherein the water depth graduations in the data display region are foot graduations.

17. The electronic watch with a meter function as claimed in claim 16 wherein each graduation corresponds to four feet in the depth graduations.

18. The electronic watch with a meter function as claimed in claim 10 wherein the water depth graduations in the data display region are meter graduations and foot graduations.

19. The electronic watch with a meter function as claimed in claim 18 wherein five graduations correspond to five meters and also correspond to 20 feet in the depth graduations.

20. The electronic watch with a meter function as claimed in claim 19 wherein the meter graduations corresponding to five graduations are integer multiples of 5, and for the foot graduations are integer multiples of 20.

21. The electronic watch with a meter function as claimed in claim 18 further comprising a meter depth meter corresponding to the meter graduations, and a foot depth meter corresponding to the foot graduations.

22. In an electronic watch having a watch face and a first annular scale surrounding the watch face for displaying the time, the improvement comprising:

means for measuring an external parameter, means responsive to said measuring means for generating a signal indicative of a value of said external parameter, means for an operator to select an operating mode, a second annular scale surrounding the watch face, said second annular scale including a first arcuate portion and a second arcuate portion which does not overlap the first arcuate portion, means responsive to said signal generating means for displaying said value about the first arcuate portion of said second annular scale, and means for displaying said selected operating mode about the second arcuate portion of said second annular scale.

23. The electronic watch of claim 22 further comprising a first set of hands for displaying the time about said first annular scale and a second set of hands for displaying the value and operating mode about said second annular scale.

24. The electronic watch of claim 23 wherein said first and second portions comprise the entirety of said second annular scale, and said first portion comprises substantially the entirety of said second annular scale.

25. The electronic watch of claim 24 wherein said operating modes includes an alarm mode, said electronic watch further comprising an alarm.

26. The electronic watch of claim 25 wherein said external parameter is depth, and said first portion includes water depth graduations.

27. The electronic watch of claim 26 wherein said first portion comprises an arcuate range from 0 to 55 minutes and said second portion comprises a second arcuate range from 56 to 59 minutes.

28. The electronic watch of claim 27 wherein said water depth graduations include a first range of graduations at one scale and a second range of graduations at a second scale.

29. The electronic watch of claim 28 wherein each of said ranges are linear with respect to a radial angle, but different with respect to each other.

30. The electronic watch of claim 25 wherein said second portion includes means for displaying a first operating mode corresponding to time display only, a second operating mode corresponding to a depth alarm mode and a third operating mode corresponding to a depth measurement mode.

* * * * *